US007242240B2

(12) United States Patent
Gierkink

(10) Patent No.: US 7,242,240 B2
(45) Date of Patent: Jul. 10, 2007

(54) LOW NOISE BANDGAP CIRCUIT

(75) Inventor: Sander Gierkink, Hoboken, NJ (US)

(73) Assignee: Agere Systems, Inc., Allentown, PA (US)

( * ) Notice: Subject to any disclaimer, the term of this patent is extended or adjusted under 35 U.S.C. 154(b) by 0 days.

(21) Appl. No.: 11/122,417

(22) Filed: May 5, 2005

(65) Prior Publication Data

US 2006/0250178 A1 Nov. 9, 2006

(51) Int. Cl.
*G05F 3/02* (2006.01)

(52) U.S. Cl. ..... 327/539; 323/314

(58) Field of Classification Search ..... 327/539; 323/313–314

See application file for complete search history.

(56) References Cited

U.S. PATENT DOCUMENTS

| | | | | |
|---|---|---|---|---|
| 5,614,850 | A * | 3/1997 | Corsi et al. | 327/55 |
| 6,137,278 | A * | 10/2000 | Koffler et al. | 323/313 |
| 6,288,525 | B1 * | 9/2001 | Fischer | 323/313 |
| 6,373,330 | B1 * | 4/2002 | Holloway | 327/539 |
| 6,570,438 | B2 * | 5/2003 | Coady | 327/539 |

* cited by examiner

*Primary Examiner*—Long Nguyen
*Assistant Examiner*—Ryan Jager

(57) ABSTRACT

The bandgap circuit comprising a plurality of cells that are sequentially connected to provide summation of $\Delta V_{BE}$ of each cell, with low noise. Each cell is formed of a plurality of NPN bipolar transistors. The transistors form an amplifier that generates a voltage that is proportional to absolute temperature.

19 Claims, 5 Drawing Sheets

| | $I_{DD}$ [μA] | $V_{noise}$ [nV/sqrtHz] | $R_{eq,noise}$ [kΩ] | $I_{DD} \cdot R_{eq,noise}$ NORMALIZED |
|---|---|---|---|---|
| CLASSIC BANDGAP | 100 | 53 | 170 | 1 |
| BANDGAP 1 (FIG. 3) | 485 | 10.7 | 7 | 0.2 |
| BANDGAP 2 (FIG. 4) | 303 | 9.6 | 5.6 | 0.1 |

FIG. 5

LOW NOISE BANDGAP CIRCUIT

BACKGROUND OF THE INVENTION

1. Field of the Invention

The present invention relates to electronic circuits and, more specifically, to bandgap voltage reference circuits.

2. Description of the Related Art

Bandgap voltage regulators are typically used to provide substantially constant reference voltages for circuits that operate in environments subject to temperature fluctuation. Generally, bandgap circuits develop a voltage that consists of a summation of a base emitter voltage and a voltage proportional to the difference between the base-to-emitter voltages, $\Delta V_{BE}$, of two bipolar transistors. This difference is linear with temperature and has a certain positive temperature coefficient $+TC_{\Delta VBE}$. On the other hand the base emitter voltage $V_{BE}$ of a bipolar transistor has a negative temperature coefficient $-TC_{VBE}$. By proper scaling of the $\Delta V_{BE}$ and adding it to a $V_{BE}$, a voltage results that has a zero temperature coefficient. Because $TC_{\Delta VBE}$ is smaller than $TC_{VBE}$, the $\Delta V_{BE}$ needs to be scaled (amplified) to cancel the $TC_{VBE}$. A disadvantage of amplifying $\Delta V_{BE}$ is that circuit noise is also amplified.

FIG. 1 depicts a prior art circuit 100 for amplifying $\Delta V_{BE}$ to create a bandgap reference circuit. The circuit 100 is comprised of four transistors. Two transistors M1 and M2 form a current mirror, forcing the collector currents of the bipolar transistors Q1 and Q2 to be equal. The transistors Q1 and Q2 generate the voltage difference $\Delta V_{BE}$ across $R_1$ equal to (kT/q)*ln(M) where M is the ratio in emitter area between Q2 and Q1. The ratio between resistors R1 and R2 determines the scaling factor of $\Delta V_{BE}$. The output voltage is the sum of the scaled $\Delta V_{BE}$ and the base emitter voltage $V_{BE}$ of Q1. More specifically, the power supply $V_{DD}$ (e.g., 3.3 volts) is connected to the source terminals of transistors M1 and M2. Transistor M1 has a drain terminal connected to the collector and base terminal of transistor Q1 and the emitter terminal of transistor Q1 is connected to ground through resistor R2. The gate and drain terminals of transistor M2 are connected to one another and the gate terminals of transistors M1 and M2 are connected to one another. The drain and gate terminal of transistor M2 are connected to the collector terminal of transistor Q2 and the emitter terminal of transistor Q2 is connected to ground through both resistors R1 and R2. In this manner, transistors M1 and M2 form a current mirror and transistors Q1 and Q2 generate the voltage difference $\Delta V_{BE}$. For this circuit, the bandgap voltage is given by $V_{bandgap}=V_{BE}+\Delta V_{BE}\cdot(R2/R1)$. Due to the multiplication of $\Delta V_{BE}$,the noise of resistor R1 is multiplied at the output such that its noise power contribution is equivalent to $$4\cdot k\cdot T\cdot R_1\left(\frac{R_2}{R_1}\right)^2,$$

where k is the Boltzmann constant, T is temperature and $R_1$ and $R_2$ are the resistance values of resistors $R_1$ and $R_2$.

As can be seen by the noise equation, the classic bandgap circuit 100 is very noisy. By reducing the impedance level of resistors R1 and R2 the level of noise can be reduced, but the power consumption of the circuit increases.

In other attempts to reduce the noise of the bandgap circuit, the $\Delta V_{BE}$ values of the transistor combinations are stacked to reduce the amount of amplification needed to obtain a reference voltage. Stacking transistors reduces the amplification needed in each amplification stage and thus reduces noise level in the output signal. In the stacked transistor circuit, the $\Delta V_{BE}$ values of each transistor combination add directly to one another, while the noise adds on a power basis. Since power is proportional to voltage squared, the ratio of the output voltage (after amplification) to noise voltage decreases by the square root of the number of stacked $\Delta V_{BE}$ values. In one known realization, U.S. Pat. No. 6,288,525, the stacked transistor circuit uses both NPN and PNP transistors as well as an operational amplifier. As such, these circuits are less noisy than traditional bandgap circuits, but they are significantly more complex. A further reduction in noise and complexity can be achieved with the present invention.

Therefore there is a need in the art for a low noise bandgap circuit having a relatively simple structure.

SUMMARY OF THE INVENTION

The bandgap circuit of the present invention comprises a plurality of NPN bi-polar transistors that are arranged into a plurality of cells. Instead of generating a single $\Delta V_{BE}$ and scaling it to the required level, several cells are sequentially connected to provide a summation of several $\Delta V_{BE}$ values. This summation avoids significant noise amplification. Each cell generates a $\Delta V_{BE}$ that is proportional to absolute temperature. The summation of the $\Delta V_{BE}$ values and one $V_{BE}$ creates a bandgap, reference voltage. Each cell comprises a current mirror that drives a $\Delta V_{BE}$ cell comprising four NPN bipolar transistors. In one embodiment, four cells are coupled in series to form the output reference voltage

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

FIG. 5 is a table containing operational characteristics of a simulation of a standard bandgap circuit compared to the operational characteristics of a simulation of the first and second embodiments of the invention.

DETAILED DESCRIPTION

Figure 2:
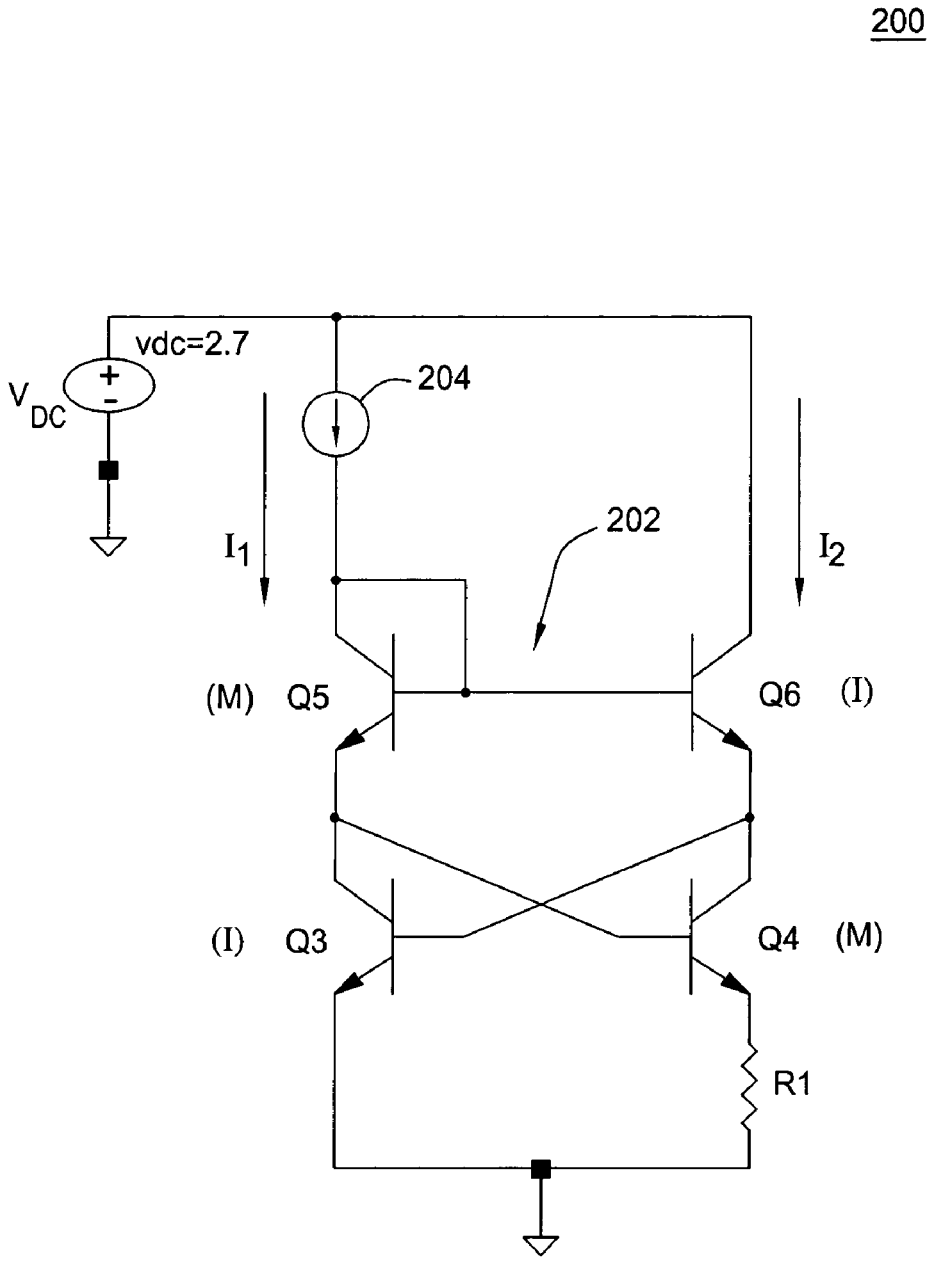
FIG. 2 is a schematic diagram of one embodiment a cell of the present invention.

FIG. 2 depicts a cell 200 comprising an input current I1 and a $\Delta V_{BE}$-cell 202 having transistors Q3, Q4, Q5 and Q6 and a resistor R1. The emitter areas of transistors Q4 and Q5 are M times larger than those of transistors Q3 and Q6. A low voltage power supply, $V_{DC}$, having a voltage of approximately 2.7 Volts is used. The current source 204 (supplying current $I_1$) is coupled between the power supply $V_{DC}$ and the collector terminal of transistor Q5. For simplicity, the elements: collector terminal, base terminal and emitter terminal, may be referred to herein as a collector, base and emitter. The collector of transistor Q5 is connected to the base of transistor Q5, while the emitter of transistor Q5 is connected to the collector of transistor Q3. The collector of transistor Q3 is also connected to the base of transistor Q4 and the base of transistor Q3 is connected to the collector of transistor Q4. The emitter of transistor Q3 is connected to ground. The collector of transistor Q6 is connected to the power supply $V_{DC}$. The base of transistor Q6 is coupled to the base of transistor Q5. The collector of transistor Q4 is connected to the emitter of transistor Q6 and the base of transistor Q3. The base of transistor Q4 is connected to the collector of transistor Q3. And the emitter of transistor Q4 is coupled to ground through a resistor R1. All four transistors in this cell 200 are NPN bi-polar transistors.

For the circuit of FIG. 2, $\Delta V_{BE}$ is defined by the following equation $$\Delta V_{BE} = \frac{k \cdot T}{q} \cdot \ln\left(\frac{I_2 I_1}{I_1 \cdot I_2} \cdot M^2\right) = 2\frac{k \cdot T}{q}\ln(M) \quad (1)$$

As shown by equation (1), an important property of this circuit is that the voltage $\Delta V_{BE}$ across resistor R1 is a PTAT voltage (i.e., a voltage that is proportional to absolute temperature). The voltage is independent of whatever the temperature dependency is of current $I_1$ and $I_2$. As such, a current mirror is not necessary to force $I_1$ equal to $I_2$. This avoids the need for a startup circuit.

To achieve an appropriate value for the reference voltage, a plurality of cells 200 can be stacked, e.g., serially connected to one another such that the $\Delta V_{BE}$ voltages are additive, yet the noise produced by each cell is uncorrelated with the noise in any other cell. Thus, the $\Delta V_{BE}$ voltages will accumulate to form the desired reference voltage, yet the noise will not add in a correlated fashion.

Figure 3:
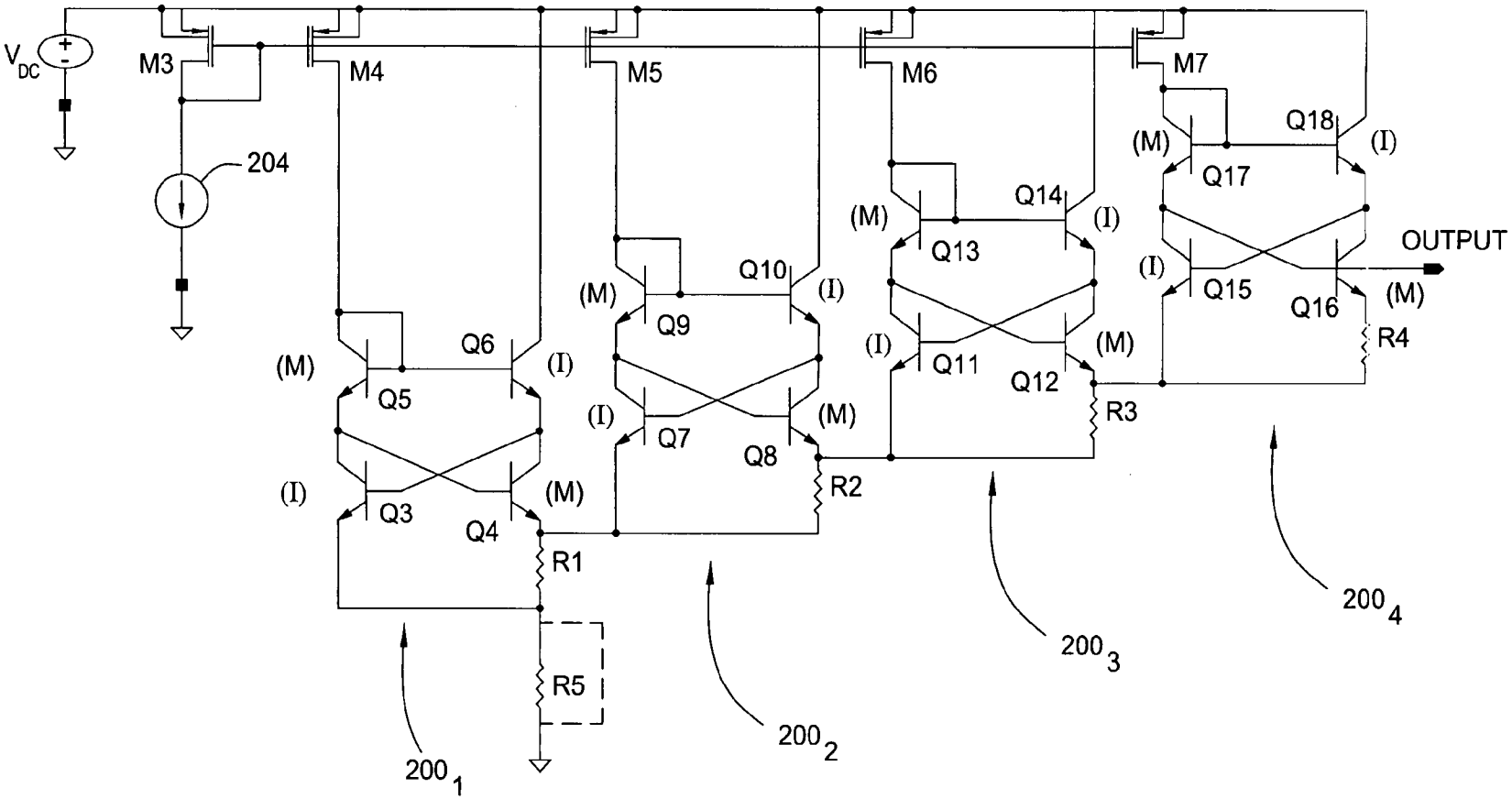
FIG. 3 is a schematic diagram of a multi-cell bandgap circuit in accordance with a first embodiment of the present invention.

FIG. 3 depicts a schematic diagram of a first embodiment of the present invention comprising four cells $\mathbf{200}_1$, $\mathbf{200}_2$, $\mathbf{200}_3$, $\mathbf{200}_4$. The first cell $\mathbf{200}_1$ is comprised of four transistors Q3, Q4, Q5 and Q6 and resistor R1 connected in the manner as described with reference to FIG. 2. MOSFETs M3 and M4 mirror the current of current source $I_1$ to the input branch of cell $\mathbf{200}_1$. The second cell $\mathbf{200}_2$ comprises transistors Q7, Q8, Q9 and Q10 and resistor R2. The third cell $\mathbf{200}_3$ comprises transistors Q11, Q12, Q13, Q14 and resistor R3. The fourth cell $\mathbf{200}_4$ comprises transistors Q15, Q16, Q17, Q18 and resistor R4. The emitter areas of transistors Q4,5,8,9,12,13,16,17 are M times larger than the emitter areas of transistors Q3,6,7,10,11,14,15,18. The input currents for cells $\mathbf{200}_2$, $\mathbf{200}_3$, $\mathbf{200}_4$ are mirrored by MOSFET transistors M3 in conjunction with M5, M6 and M7, respectively from the current source 204. To couple the cells to one another, the source and gate terminals of the current source transistors M4, M5, M6 and M7 are coupled in parallel to one another.

In addition, the junction between transistor Q4 and resistor R1 is coupled to the emitter of transistor Q7 and the resistor R2. The emitter of transistor Q8 is coupled to the emitter of transistor Q11 and the resistor R3 and the emitter of transistor Q12 is connected to the emitter of Q15 and the resistor R4. In this manner, the cells $\mathbf{200}_1$, $\mathbf{200}_2$, $\mathbf{200}_3$, $\mathbf{200}_4$ are sequentially connected to provide a reference voltage that is the summation of $\Delta V_{BE}$ from each cell $\mathbf{200}_1$, $\mathbf{200}_2$, $\mathbf{200}_3$, $\mathbf{200}_4$ and one $V_{BE}$ of transistor Q16. The $\Delta V_{BE}$ of each cell is set by the transistor ratio M (see equation (1)). By adding enough stages (typically four) and proper transistor scaling, (note that the scaling of transistors in different stages is not necessarily identical), a desired bandgap reference voltage can be achieved. When equal scaling is used in all cells the output voltage is given by: Vout=8*(kT/q)*ln(M)+$V_{BE}$. A small additional resistor can be placed in the ground lead to fine trim the output bandgap voltage. This resistor, shown as resistor R5, is shown having an optional shunt around the resistor to indicate the optional nature of the resistor.

When identical stages are used, all $\Delta V_{BE}$ values are equal in each stage. The total current of all cells to the right of a cell plus the current in the output branch of that cell flows through the resistor of that cell. To maintain approximately equal currents in all output branches (transistors $Q_{4,6}$ and $Q_{8,10}$ and $Q_{12,14}$ and $Q_{16,18}$), the resistors need to be scaled smaller moving from the output towards ground. In one embodiment of the invention, the resistor values are scaled from R4 to R1. With R4 being normalized to a value of one (R), R3 is one-third (R/3), R2 is one-fifth (R/5) and R1 is one-seventh (R/7). This selection of scaling factors provides about equal currents in the output branches of each cell. It should also be noted that, in order to generate PTAT voltages $\Delta V_{BE}$s, the current flowing into the PMOS mirror does not necessarily have to be a PTAT current as mentioned above.

Since the noise of all resistors is uncorrelated and the resistors through the chain are scaled to a smaller value nearer to ground, the summation of $\Delta V_{BE}$ values provide a much lower output noise than provided by the classical bandgap circuit.

Figure 1:
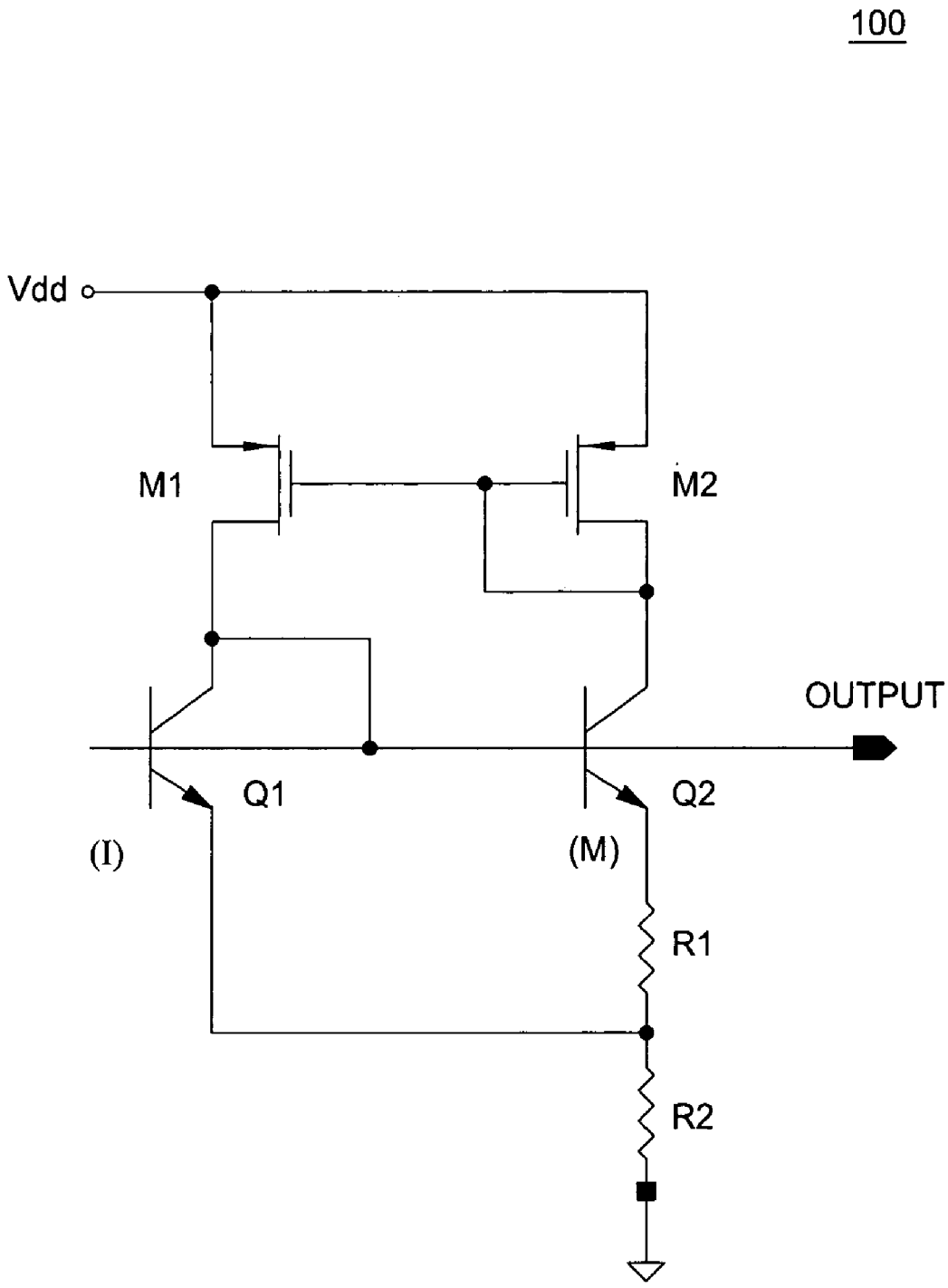
(PRIOR ART) FIG. 1
FIG. 1 is a schematic diagram of a prior art bandgap circuit.

A possible drawback of the circuit of FIG. 3 is that in terms of voltage headroom it requires an additional $V_{BE}$ of transistor Q17 on top of the output bandgap voltage, compared to the circuit of FIG. 1. If necessary however, the cell $\mathbf{200}_4$ in FIG. 3 can be replaced by a cell comprising of transistors $M_1$, $M_2$, $Q_1$, $Q_2$ and resistor $R_1$ in FIG. 1. In that case, Vout=7(kT/q)*ln(M)+$V_{BE}$.

Figure 4:
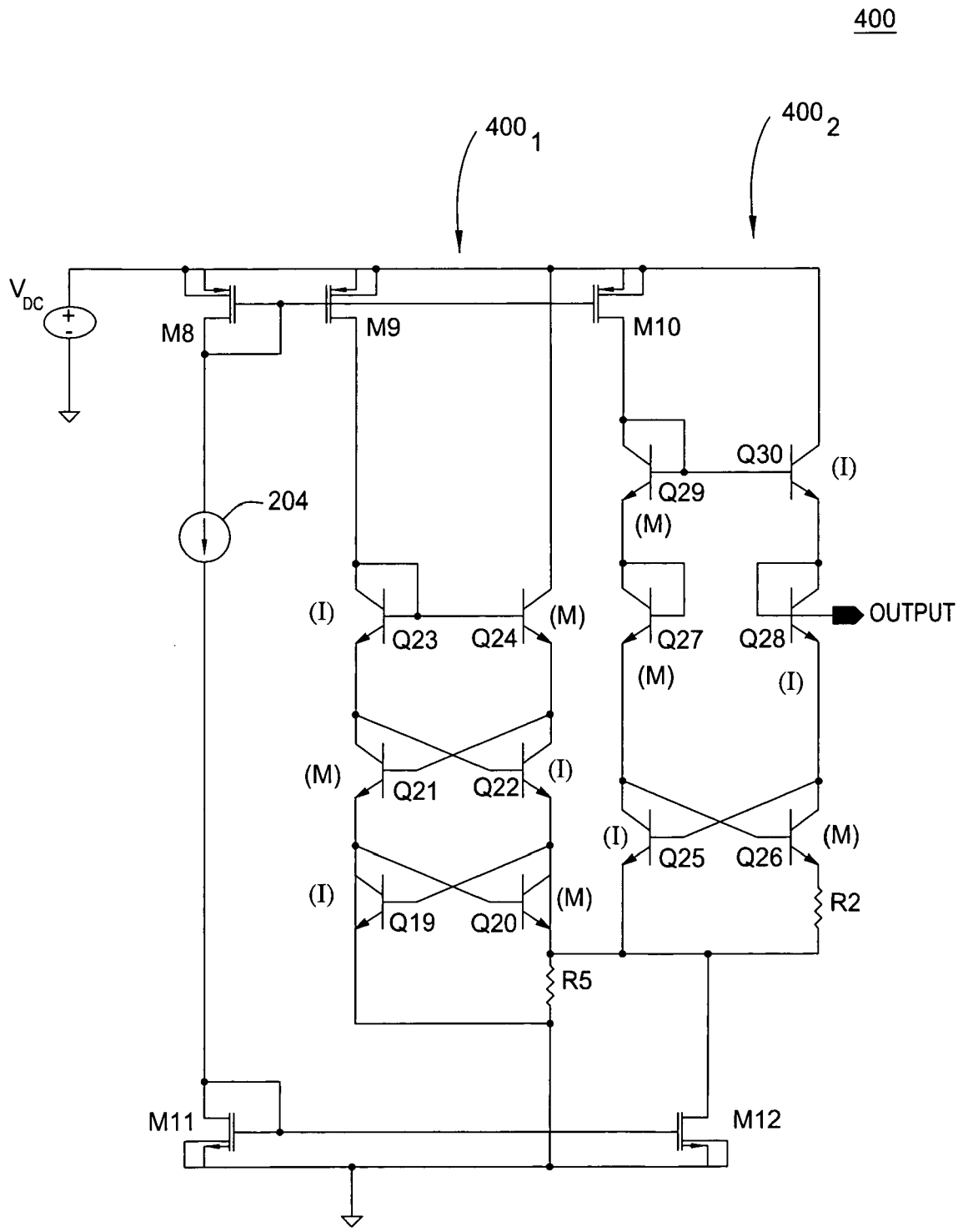
FIG. 4 is a schematic diagram of a second embodiment of a multi-cell bandgap circuit in accordance with a second embodiment of the present invention.

FIG. 4 depicts a schematic diagram of a second embodiment of the invention that can be used when sufficient voltage headroom is available. In the depicted embodiment, the VDC voltage is about 3.3 Volts DC. In the embodiment of reference circuit 400, there are two cells $\mathbf{400}_1$ and $\mathbf{400}_2$. Each cell comprises a current mirror formed of a MOSFET transistor M9 or M10 working in combination with MOSFETs M8, M11 and M12. Cell $\mathbf{400}_1$ comprises six NPN bipolar transistors Q19, Q20, Q21, Q22, Q23, and Q24. Similarly, cell $\mathbf{400}_2$ comprises six NPN bipolar transistors Q25, Q26, Q27, Q28, Q29 and Q30.

In cell $\mathbf{400}_1$, the transistors Q23, Q24, Q21 and Q22 are coupled to one another in the identical manner as cell 200 in FIG. 2. The transistors Q19 and Q20 are coupled in a similar manner as the transistors Q21 and Q22. Specifically, the emitter of transistor Q21 is coupled to the collector of Q19 and the base of transistor Q20. The emitter of transistor Q19 is coupled to ground, while the base of transistor Q19 is coupled to the collector of transistor Q20. The base of transistor Q20 is connected to the collector of transistor Q19 and the emitter of transistor Q20 is connected to ground through resistor R5. The emitter areas of transistors Q20, Q21, Q24 are M times that of transistors Q19, Q22, Q23.

In cell $\mathbf{400}_2$, transistors Q29, Q30, Q25, and Q26 are arranged in a similar manner as cell 200 in FIG. 2, except transistors Q27 and Q28 are added in the emitter to collector connection between transistors Q29 and Q25 as well as transistors Q30 and Q26. Specifically, transistor Q27 has a collector coupled to the emitter of transistor Q29 and an emitter coupled to the collector of transistor Q25. The base and collector of transistor Q27 are connected together. Transistor Q28 is connected in a similar manner between transistors Q30 and Q26. The emitter areas of transistors Q26, Q27, Q29 are M times that of transistors Q25, Q28, Q30.

The two cells are coupled together in a similar manner to the cells in FIG. 3, i.e., the emitter of transistor Q20 is connected to the emitter of transistor Q25 as well as the resistor R6, the gates of current source MOSFETs are connected together, and the sources of the current source MOSFETs are connected together. The scaling factor used in this embodiment is one (R) for resistor R6 and one-half (R/2) for resistor R5.

The reference voltage from the circuit 400 is taken from the base of transistor Q26. The output voltage is given by: $Vout=6*(kT/q)*\ln(M*(I_2/I_1))+V_{BE}$. To guarantee that the summation of $\Delta V_{BE}$s is truly PTAT, the temperature coefficients of currents $I_{1,2}$ have to be equal. The temperature coefficient of $I_2$ is PTAT. To guarantee that $I_1$ is PTAT, the current $I_0$ flowing through transistors Q29,27,25 and which is not necessarily PTAT must be "shunted" away before it enters into resistor R5. This function is performed by M11,12. MOSFETs M8, M9, M10, M11, and M12 control the current to each of the cells $\mathbf{400}_1$ and $\mathbf{400}_2$. In this embodiment of the invention, the $\Delta V_{BE}$ of cells $\mathbf{400}_1$ and $\mathbf{400}_2$ are cumulative and the noise produced in each cell is uncorrelated. The uncorrelated nature of the noise of the two circuits will provide a low noise output voltage. Also in FIG. 4 a small resistor may be used, similar to resistor R5 in FIG. 3.

FIG. 5 depicts a table containing the estimated operational characteristics for the classic bandgap circuit as well as the first and second embodiments of the invention depicted in FIGS. 3 and 4. These characteristics were generated by circuit simulation. The comparative noise level in the output voltage of each circuit is defined by the normalized value of $I_{DD}\cdot R_{eq}$, noise. Note that the first embodiment improves the noise level by a factor of five and the second embodiment improves the noise level by a factor of ten over the conventional bandgap circuit.

While the foregoing is directed to embodiments of the present invention, other and further embodiments of the invention may be devised without departing from the basic scope thereof, and the scope thereof is determined by the claims that follow.

The invention claimed is:

1. A bandgap circuit comprising: a plurality of cells, each cell having at least four transistors, where the cells are connected in series to sum a $\Delta V_{BE}$ of each cell to produce an output voltage and each cell comprises: a first transistor of said at least four transistors having a collector connected to a current source and to a base of the first transistor, the base of the first transistor connected to a base of a fourth transistor of said at least four transistors, a emitter of the first transistor connected to a collector of a second transistor of said at least four transistors, the collector of the second transistor connected to a base of a third transistor of said at least four transistors, a base of the second transistor connected to a collector of the third transistor, an emitter of the second transistor connected to a first terminal of a resistor, an emitter of the third transistor connected to a second terminal of the resistor, the collector of the third transistor connected to an emitter of the fourth transistor; and a collector of the fourth transistor connected to a voltage source; and the first terminal of the resistor within a first cell of the plurality of cells is coupled to ground, and the second terminal of the resistor in each other cell of the plurality of cells is connected to the emitter of the third transistor of the previous cell of the plurality of cells.

2. The bandgap circuit of claim 1 wherein said at least four transistors in each cell of said plurality of cells comprises four NPN transistors.

3. The bandgap circuit of claim 1 further comprises another resistor connected from the first terminal of the resistor of the first cell of the plurality of cells to ground.

4. The bandgap circuit of claim 3 wherein said plurality of cells comprises four cells.

5. The bandgap circuit of claim 4 wherein the resistor in each of the four cells is scaled with respect to each other resistor.

6. The bandgap circuit of claim 5 wherein the resistor of the first cell has a value of R/3, the resistor of a second cell of the plurality of cells has a value R/3, the resistor of a third cell of the plurality of cells has a value R/5, the resistor of a fourth cell of the plurality of cells has a value R/7, where the first cell contains an output of the bandgap circuit.

7. The bandgap circuit of claim 1 wherein said at least four transistors in each cell of said plurality of cells comprises six NPN bipolar transistors.

8. The bandgap circuit of claim 1 wherein each of the at least four transistors, has an emitter area, wherein a ratio (M) between emitter areas of at least two pairs of the at least four transistors defines the $\Delta V_{BE}$ of a cell of the plurality of cells containing the at least two pairs of transistors.

9. The bandgap circuit of comprising a plurality of cells comprising a plurality of transistors wherein a first cell comprises: a first transistor of the plurality of transistors having a collector connected to a current source and to a base of the first transistor the base of the first transistor connected to a base of a fourth transistor of the plurality of transistors, an emitter of the first transistor connected to a collector of a second transistor of the plurality of transistors, the collector, a collector of the second transistor connected to a base of a third transistor of the plurality of transistors, a base of the second transistor connected to a collector of the third transistor, an emitter of the second transistor connected to a collector of a fifth transistor of the plurality of transistors, an emitter of the third transistor connected to a collector of a sixth transistor of the plurality of transistors, the collector of the third transistor connected to an emitter of the fourth transistor; and the collector of the fourth transistor connected to a voltage source, the collector of the fifth transistor is connected to a base of the sixth transistor, a base of the fifth transistor is connected to the collector of the sixth transistor, an emitter of the fifth transistor is connected to a first terminal of a first resistor, and an emitter of the sixth transistor is connected to a second terminal of the first resistor; a second cell comprises: a seventh transistor of the plurality of transistors having a collector connected to a current source and to a base of the seventh transistor, the base of the seventh transistor connected to a base of a tenth transistor or the plurality of transistors, an emitter of the seventh transistor connected to a collector of the eighth transistor of the plurality of transistors, a collector of the eighth transistor connected to a base of the eighth transistor, an emitter of the eighth transistor connected to a collector of to a eleventh transistor of the plurality of transistors, a collector of a ninth transistor of the plurality of transistors connected to an emitter of the tenth transistor; a base of the ninth transistor connected to the collector of the ninth transistor and a collector of the tenth transistor connected to a voltage source, the collector of the eleventh transistor is connected to a base of a twelfth transistor of the plurality of transistors, a base of the eleventh transistor is connected to a collector of the twelfth transistor, an emitter of the eleventh transistor is connected to a first terminal of a second resistor, and an emitter of the twelfth transistor is connected to a second terminal of the second resistor; and the first terminal of the first resistor is connected to ground and the first terminal of the second resistor is connected to a current source and to the emitter of the sixth transistor.

10. The bandgap circuit of claim 9 wherein the first resistor is scaled with respect to the second resistor.

11. The bandgap circuit of claim 10 wherein the first resistor has value R/2 and the second resistor has a value R.

12. A bandgap circuit comprising: four cells where the four cells are connected in series to sum a $\Delta V_{BE}$ of each cell of the four cells to produce an output voltage; each cell of the four cells comprises a first transistor having a collector connected to a current source and to a base of the first transistor, the base of the first transistor connected to a base of a fourth transistor, an emitter of the first transistor connected to a collector of a second transistor, the collector of the second transistor connected to a base of a third transistor, a base of the second transistor connected to a collector of the third transistor, an emitter of the second transistor connected to a first terminal of a resistor, an emitter of the third transistor connected to a second terminal of said resistor, the collector of the third transistor connected to an emitter of the fourth transistor; and a collector of the fourth transistor connected to a voltage source; wherein said first terminal of the first resistor within a first cell of the four cells is coupled to ground, and the first terminal of the resistor in each other cell of the four cells is connected to the emitter of the third transistor of the previous cell.

13. The bandgap circuit of claim 12 wherein a another resistor is connected from the first terminal of the first resistor of said first cell to ground.

14. The bandgap circuit of claim 12 wherein the resistor in each of the four cells is scaled with respect to each other resistor.

15. The bandgap circuit of claim 14 wherein a the resistor of the first cell of said four cells has a value R, the resistor of a second cell of said four cells has a resistor R/3, the resistor of a third cell of said four cells has a value R/5, the resistor of a fourth cell of said four cells has a value R/7, where the first cell contains the output voltage of the bandgap circuit.

16. The bandgap circuit of claim 12 wherein each of the first, second, third and fourth of said four cells have an emitter area, and a ratio (M) of emitter area of the first and third transistors to the emitter area of the second and forth transistors defines the $\Delta V_{BE}$ of a cell containing the transistors.

17. A bandgap circuit comprising: two cells where the cells are connected in series to sum a $\Delta V_{BE}$ of each cell to produce an output voltage; a first cell comprises: a first transistor having a collector connected to a current source and to a base of the first transistor, the base of the first transistor connected to a base of a fourth transistor, an emitter of the first transistor connected to a collector of a second transistor, the collector of the second transistor connected to a base of a third transistor, a base of the second transistor connected to a collector of the third transistor, an emitter of the second transistor connected to a collector of a fifth transistor, an emitter of the third transistor connected to a collector of a sixth transistor, the collector of the third transistor connected to an emitter of the fourth transistor; and a collector of the fourth transistor connected to a power supply, the collector of the fifth transistor is connected to a base of the sixth transistor, a base of the fifth transistor is connected to the collector of the sixth transistor, an emitter of the fifth transistor is connected to a first terminal of a first resistor, and an emitter of the sixth transistor is connected to a second terminal of the first resistor; a second cell comprises: a seventh transistor having a collector connected to a current source and to a base of the seventh transistor, the base of the seventh transistor connected to a base of the tenth transistor, a emitter of the seventh transistor connected to a collector of an eighth transistor, the collector of the eighth transistor connected to a base of the eighth transistor, an emitter of the eighth transistor connected to a collector of an eleventh transistor, a collector of a ninth transistor connected to an emitter of the tenth transistor; a base of the ninth transistor connected to the collector of the ninth transistor and a collector of the tenth transistor connected to the power supply, the collector of an eleventh transistor is connected to a base of a twelfth transistor, a base of the eleventh transistor is connected to a collector of the twelfth transistor, an emitter of the eleventh transistor is connected to a first terminal of a second resistor, and an emitter of the twelfth transistor is connected to a second terminal of the second resistor; and the first terminal of the first resistor is connected to ground and the first terminal of the second resistor is connected to a current source and to the emitter of the sixth transistor.

18. The bandgap circuit of claim 17 wherein the first resistor is scaled with respect to the second resistor.

19. The bandgap circuit of claim 18 wherein the first resistor has value R/2 and the second resistor has a value R.

* * * * *